US010291997B2

(12) United States Patent
Cai et al.

(10) Patent No.: US 10,291,997 B2
(45) Date of Patent: May 14, 2019

(54) SPEAKER DEVICE

(71) Applicant: GOERTEK INC., WeiFang (CN)

(72) Inventors: Xiaodong Cai, WeiFang (CN); Guodong Zhao, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/568,126

(22) PCT Filed: Nov. 16, 2015

(86) PCT No.: PCT/CN2015/094669
§ 371 (c)(1),
(2) Date: Oct. 20, 2017

(87) PCT Pub. No.: WO2016/169253
PCT Pub. Date: Oct. 27, 2016

(65) Prior Publication Data

US 2018/0152800 A1 May 31, 2018

(30) Foreign Application Priority Data

Apr. 20, 2015 (CN) ..... 2015 1 0185711

(51) Int. Cl.
*H04R 1/44* (2006.01)
*H04R 31/00* (2006.01)
(Continued)

(52) U.S. Cl.
CPC ..... *H04R 31/003* (2013.01); *H04R 1/44* (2013.01); *H04R 7/122* (2013.01); *H04R 7/125* (2013.01);
(Continued)

(58) Field of Classification Search
CPC ..... H04R 31/003; H04R 1/04; H04R 7/22; H04R 9/046; H04R 9/06; H04R 2231/001;
(Continued)

(56) References Cited

U.S. PATENT DOCUMENTS 3,862,376 A * 1/1975 White ..... H04R 3/002 181/167
3,961,378 A * 6/1976 White ..... H04R 31/003 29/594
6,724,910 B1 * 4/2004 Heed ..... H04R 7/12 381/423

FOREIGN PATENT DOCUMENTS

CN 203748004 U 7/2014
CN 204217118 U 3/2015
(Continued)

OTHER PUBLICATIONS

International Search Report for International Patent Application No. PCT/CN2015/094669 filed on Nov. 16, 2015.

*Primary Examiner* — Tuan D Nguyen

(57) ABSTRACT

Disclosed is a speaker device, comprising a vibration system, a magnetic circuit system, and an auxiliary system for accommodating and fixing the vibration system and the magnetic circuit system. The vibration system comprises a diaphragm, the auxiliary system comprises a front cover, a side of the front cover is provided a waterproof pad, said side being away from the vibration system. The diaphragm are bonded to the front cover and the waterproof pad by integrally injection molding. The speaker device of the present invention satisfies terminal waterproof requirements for IPX7 and above, and has a good waterproof effect. Besides, a production process of the waterproof speaker device is simplified, production efficiency is increased, production
(Continued)

costs of the speaker device are decreased, and the reprocessed product yield of the speaker device is increased.

11 Claims, 2 Drawing Sheets

(51) Int. Cl.
*H04R 9/06* (2006.01)
*H04R 7/12* (2006.01)
*H04R 9/04* (2006.01)

(52) U.S. Cl.
CPC ..... *H04R 9/046* (2013.01); *H04R 9/06* (2013.01); *H04R 9/045* (2013.01); *H04R 2231/001* (2013.01); *H04R 2307/021* (2013.01); *H04R 2307/025* (2013.01); *H04R 2307/029* (2013.01); *H04R 2400/11* (2013.01); *H04R 2499/11* (2013.01)

(58) Field of Classification Search
CPC ..... H04R 2307/025; H04R 2207/029; H04R 2400/11
See application file for complete search history.

(56) References Cited

FOREIGN PATENT DOCUMENTS

| | | |
|---|---|---|
| CN | 204231661 U | 3/2015 |
| CN | 104954954 A | 9/2015 |

* cited by examiner

SPEAKER DEVICE

This application is a U.S. National Stage of PCT/CN 2015/094669, filed Nov. 16, 2015, which claims the priority benefit of Chinese Patent Application No. 201510185711.5, filed on Apr. 20, 2015, the disclosures of which are incorporated herein by reference.

TECHNICAL FIELD

The present invention relates to the field of electroacoustics, and more particularly, to a speaker device good in waterproof effect and simple in assembly technology.

BACKGROUND

With the development of science and technology, portable electronic devices attract widespread attention. With the popularization of the portable electronic devices, various performances of the portable electronic devices become focus of attention. For example, waterproof and dustproof functions of the portable electronic devices have drawn more and more attention. Since the speaker device is main acoustic units of portable electronic terminals, its waterproof and dustproof functions have drawn more and more attention in this field.

A speaker device of the prior art includes a vibration system, a magnetic circuit system, and an auxiliary system for accommodating and fixing the vibration system and the magnetic circuit system. The auxiliary system includes a front cover. To ensure waterproof characteristics of a portable electronic device, generally a waterproof adhesive tape needs to be adhered onto a side, away from the vibration system, of the front cover. That is, the front cover of the speaker device comes into contact with the portable electronic device through the waterproof adhesive tape. The waterproof adhesive tape may prevent external liquids from entering into the portable electronic device via a gap between the front cover of the speaker device and a portable terminal, and thereby ensuring the waterproof effect. However, in the conventional speaker device, it is required to additionally add a procedure of adhering the waterproof adhesive tape in the manufacturing process of the speaker device because the front cover is provided with the waterproof adhesive tape, which decreases the production efficiency and increases production costs. Furthermore, the waterproof effect cannot be guaranteed when the fixing effect of the waterproof adhesive tape and the front cover is poor; and a reprocessed product yield of the speaker device may be decreased when an adhesive strength for fixing the waterproof adhesive tape and the front cover is too large.

Therefore, it is necessary to provide an improved speaker device to overcome the defects of the speaker device in the prior art.

SUMMARY

A technical problem to be solved by the present invention is to provide a speaker device, which has good waterproof effect, and may simplify production process, increase production efficiency and decrease production cost.

In order to achieve the above objectives, the present invention adopts the following technical solutions.

A speaker device includes a vibration system, a magnetic circuit system, and an auxiliary system for accommodating and fixing the vibration system and the magnetic circuit system. The vibration system includes a diaphragm, the auxiliary system includes a front cover, and a waterproof pad is provided on a side, being away from the vibration system, of the front cover. The diaphragm are bonded to the front cover and the waterproof pad by integrally injection molding.

As a preferred technical solution, the diaphragm is made of silicone rubber material.

As a further preferred technical solution, the waterproof pad also is made of a silicone rubber material.

As a still further preferred technical solution, the diaphragm and the waterproof pad are formed of an integrally molded structure.

As a preferred technical solution, the auxiliary system further includes a housing, and an integral structure of the diaphragm, the front cover and the waterproof pad is fixedly bonded to the housing.

As a specified solution of the above solution, the vibration system further includes a voice coil and a reinforcement layer. The voice coil and the reinforcement layer are fixed to the diaphragm.

As a preferred solution of the above solution, the voice coil and/or the reinforcement layer are fixed to the diaphragm by adhering. As another preferred solution, the voice coil and/or the reinforcement layer are bonded to the diaphragm by integrally injection molding.

In the speaker device of the present invention, the diaphragm of the vibration system are bonded to the front cover and the waterproof pad of the auxiliary system by integrally injection molding, and the waterproof pad is compressed upon contact with a terminal. The speaker device of the present invention can satisfy terminal waterproof requirements for IPX7 (short-term water immersion test) and above, and thereby having a good waterproof effect. The diaphragm, the front cover and the waterproof pad are integrally molded, so that it is unnecessary to separately provide the waterproof adhesive tape on the front cover during production and assembly processes of the speaker device. Therefore, the production process of the waterproof speaker device is simplified, the production efficiency is increased, the production costs of the speaker device are decreased due to the removal of the waterproof adhesive tape, and the problem that the reprocessed product yield of the speaker device is too low due to adhesive strength of the waterproof adhesive tape is too large also can be avoided. Therefore, the speaker device of the present invention has the advantages that waterproof effect is good, production process is simplified, production efficiency is high, production cost is low and high in reprocessed product yield is high.

DESCRIPTION OF THE EMBODIMENTS

Figure 1:
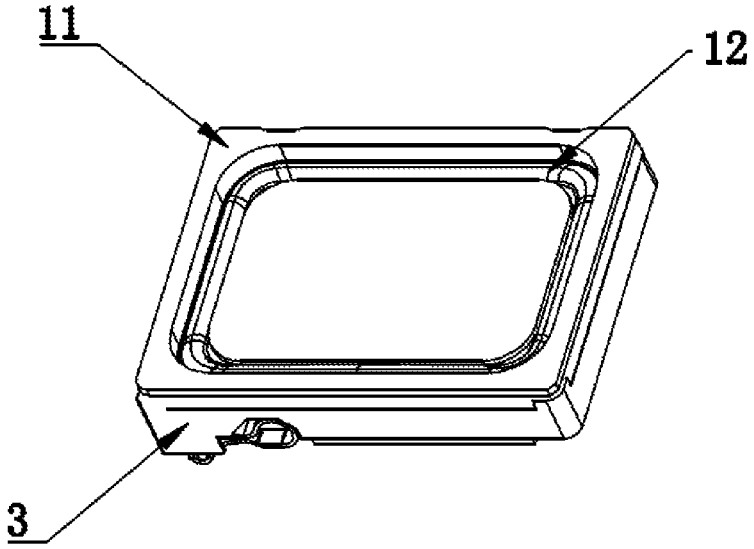
FIG. 1 is a stereo view of a speaker device according to an embodiment of the present invention.

Hereinafter, the present application will now be described in details with reference to the accompanying drawings.

As shown in the figures, the speaker device according to the embodiments of the present invention comprises a vibration system, a magnetic circuit system and an auxiliary system. The auxiliary system includes a front cover 13 and a housing 3. The front cover 13 fits with the housing 3 to accommodate and fix the vibration system and the magnetic circuit system. The vibration system includes a diaphragm 12, a voice coil 22 and a reinforcement layer 21. The voice coil 22 and the reinforcement layer 21 are fixed to the diaphragm 12. The magnetic circuit system includes a frame 43, a magnet 42 fixed to a side, which is close to the vibration system, of the frame 43, and a washer 41 fixed to the magnet. A magnetic gap is provided between the frame 43 and the magnet 42. The voice coil 22 suspends in the magnetic gap, and the voice coil 22 further includes a voice coil lead wire, which is electrically connected to a conductive member. An external driving signal enters into the voice coil 22 through the conductive member, and the current of the voice coil 22 positioned in the magnetic gap changes such that the voice coil 22 vibrates up and down by Lorentz force. Vibration of the voice coil 22 drives the diaphragm 12 to vibrate, and vibration of the diaphragm 12 incites air to make sounds. In the speaker device of the present invention, a waterproof pad 11 is further provided on an external side, being away from the vibration system, of the front cover 13. The speaker device is bonded to an external terminal device through the waterproof pad 11. The waterproof pad is provided such that the speaker device of the present invention may meet requirements for waterproofing of the external electronic terminal device.

Figure 3:
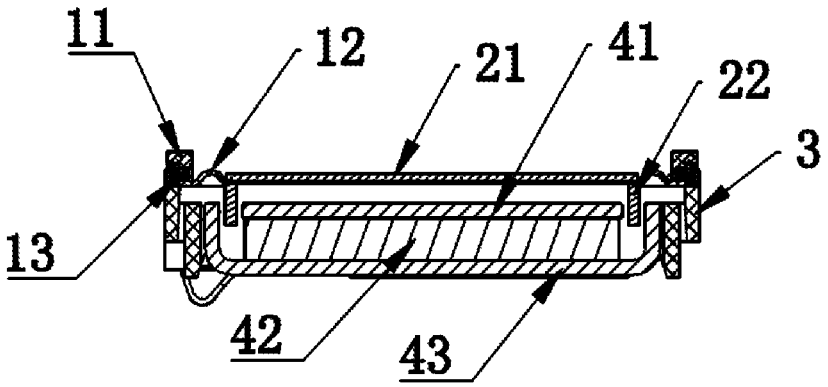
FIG. 3 is a section view of the speaker device as shown in FIG. 1.
Figure 4:
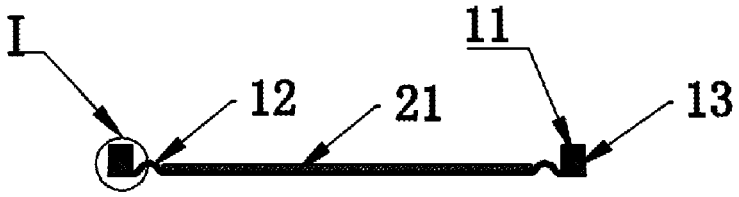
FIG. 4 is a section view of an integrative structure of a diaphragm, a front cover and a waterproof pad of the speaker device as shown in FIG. 1.
Figure 5:
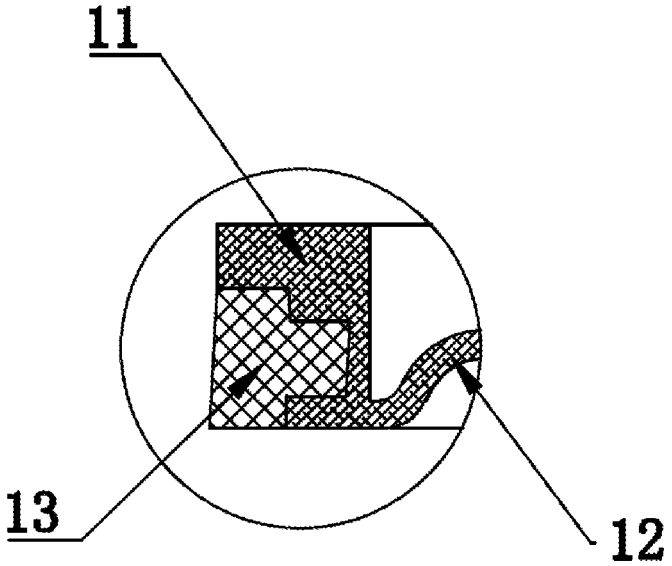
FIG. 5 is an enlarged view of Part I in FIG. 4.

As shown in FIG. 3, FIG. 4 and FIG. 5, in the speaker device of the present invention, the waterproof pad 11, the front cover 13 and the diaphragm 12 are integrally combined by injection molding, and the waterproof pad 11, the front cover 13 and the diaphragm 12 are sequentially combined by injection molding. That is, the front cover 13 is fixedly provided between the waterproof pad 11 and the diaphragm 12 so as to ensure that the speaker device comes into contact with the external terminal through the waterproof pad 11. The waterproof pad 11 is compressed upon contact with the terminal, which may satisfy waterproof requirements of the terminal device for IPX7 and above, and thereby having a good waterproof effect. Furthermore, the diaphragm 12, the front cover 13 and the waterproof pad 11 are integrally molded, so that it is unnecessary to additionally provide the waterproof adhesive tape on the front cover 13 during the production and assembly processes of the speaker device. In this way, the production process of the speaker device is simplified, the production efficiency is improved, the production costs of the speaker device are reduced due to the removal of the waterproof adhesive tape, and the problem that the reprocessed product yield is too low due to adhesive strength of the waterproof adhesive tape is too large also can be avoided.

As a preferred embodiment, the diaphragm 12 may be made of silicone rubber material, which is advantageous to be integrally injection molded with the front cover 13 and the waterproof pad 11. As a further preferred embodiment, the waterproof pad 11 also may be made of silicone rubber material, which may further reduce process difficulties in integrally injection molding the diaphragm 12, the front cover 13 and the waterproof pad 11.

In order to maximally simplify the production process of the speaker device and improve the production efficiency to a maximum extent, the diaphragm 12 of the silicone rubber material and the waterproof pad 11 of the silicone rubber material are formed with an integrated structure. As shown in FIG. 4 and FIG. 5, both the diaphragm 12 and the waterproof pad 11 are made of the same material and integrally molded. A dodging structure integrally injection molded with the front cover 13 is provided between the integrally-molded diaphragm 12 and the waterproof pad 11. The front cover 13 is bonded to the integrally-molded diaphragm 12 and the waterproof pad 11 by injection molding.

Figure 2:
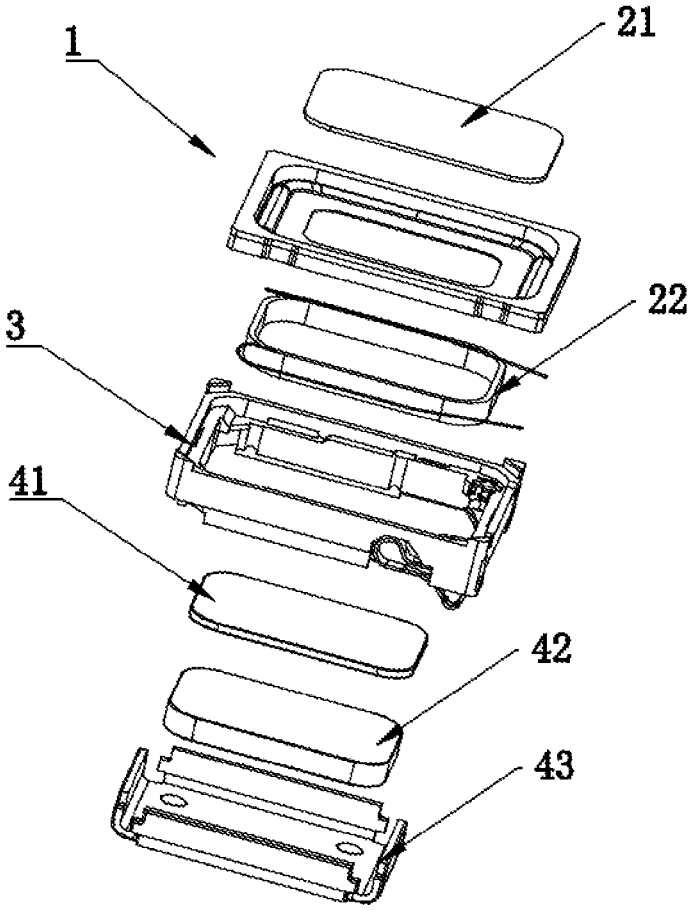
FIG. 2 is an exploded view of the speaker device as shown in FIG. 1.

As shown in FIG. 2 and FIG. 3, the speaker device of the present invention further includes a housing 3. The front cover 13 fits with the housing 3 to accommodate and fix the vibration system and the magnetic circuit system. Specifically, in the speaker device of the present invention, the integrally injection molded structure of the waterproof pad 11, the front cover 13 and the diaphragm 12 fits with the housing 3 to accommodate and fix the magnetic circuit system.

As shown in FIG. 2 and FIG. 3, the speaker device of the present invention further includes a reinforcement layer 21 and a voice coil 22. The reinforcement layer 21 and/or the voice coil 22 may be fixed to the diaphragm 12 by adhering. The reinforcement layer 21 and/or the voice coil 22 also may be fixed to the diaphragm 12 of silicone rubber by integrally injection molding and bonding. The reinforcement layer 21 and/or the voice coil 22 are bonded to the diaphragm 12 of the silicone rubber material by way of integral injection and combination, which may further simplify the production process of the speaker device and improve the production efficiency of the speaker device.

In summary, the speaker device of the present invention has the advantages that waterproof effect is good, production process is simplified, production efficiency is high, production cost is low and reprocessed product yield is high.

The above embodiments of the present invention are described merely for the purpose of illustration and are not intended to limit the present invention. All equivalent variations or modifications made by those of ordinary skill in the art according to the contents disclosed in the present invention should fall within the scope of the present invention as set forth in the appended claims.

What is claimed is:

1. A speaker device, comprising a vibration system, a magnetic circuit system, and an auxiliary system for accommodating and fixing the vibration system and the magnetic circuit system; the vibration system comprises a diaphragm, and the auxiliary system comprises a front cover, wherein a waterproof pad is provided on a side, being away from the vibration system, of the front cover, and the diaphragm is bonded to the front cover and the waterproof pad by integrally injection molding, wherein the front cover includes a rib extending towards the diaphragm, and the waterproof pad covers upper, lower and side surfaces of the rib.

2. The speaker device according to claim 1, wherein the diaphragm is made of silicone rubber material.

3. The speaker device according to claim 2, wherein the waterproof pad is made of silicone rubber material.

4. The speaker device according to claim 3, wherein the diaphragm and the waterproof pad are formed of an integrally molded structure.

5. The speaker device according to claim 2, wherein the vibration system further comprises a voice coil and a reinforcement layer, and the voice coil and the reinforcement layer are fixed to the diaphragm.

6. The speaker device according to claim 5, wherein the voice coil and/or the reinforcement layer are fixed to the diaphragm by adhering.

7. The speaker device according to claim 6, wherein the voice coil and/or the reinforcement layer are bonded to the diaphragm by integrally injection molding.

8. The speaker device according to claim 1, wherein the auxiliary system further comprises a housing, and an integral structure of the diaphragm, the front cover and the waterproof pad is fixedly bonded to the housing.

9. The speaker device of claim 1, wherein the waterproof pad covers a sidewall of the front cover from which the rib extends.

10. The speaker device of claim 9, wherein the waterproof pad extends from the sidewall over a corner of the front cover to cover an upper surface of the front cover.

11. The speaker device of claim 1, wherein the speaker device is configured to satisfy the IPX7water resistance standard when installed in a terminal.

* * * * *